US005813889A

United States Patent [19]

Perry et al.

[11] Patent Number: 5,813,889

[45] Date of Patent: Sep. 29, 1998

[54] EXPANDABLE SWIM FLIPPER

[75] Inventors: Alan Perry, 2600 Heritage Park Cir., San Jose, Calif. 95132; Peter H. Müller, Los Gatos, Calif.

[73] Assignee: Alan Perry, San Jose, Calif.

[21] Appl. No.: 806,642

[22] Filed: Feb. 25, 1997

[51] Int. Cl.[6] ..... A63B 31/11

[52] U.S. Cl. ..... 441/64

[58] Field of Search ..... 441/64, 61, 59, 441/60, 62

[56] References Cited

U.S. PATENT DOCUMENTS

| | | | |
|---|---|---|---|
| 1,607,857 | 11/1926 | Zukal | 441/64 |
| 2,980,926 | 4/1961 | Wolshin | 441/64 |
| 4,300,255 | 11/1981 | Beuchat | 9/309 |
| 4,738,645 | 4/1988 | Garofalo | 441/64 |
| 4,787,871 | 11/1988 | Tomlinson | 441/61 |
| 4,857,024 | 8/1989 | Evans | 441/64 |
| 4,954,111 | 9/1990 | Cressi | 441/61 |
| 5,338,235 | 8/1994 | Lee | 441/59 |
| 5,527,197 | 6/1996 | Evans | 441/64 |
| 5,536,190 | 7/1996 | Althen | 441/64 |

FOREIGN PATENT DOCUMENTS

| | | | |
|---|---|---|---|
| 2506619 | 12/1982 | France | 441/64 |
| 746764 | 3/1956 | United Kingdom | 441/64 |
| 1284765 | 8/1972 | United Kingdom | 441/64 |

*Primary Examiner*—Sherman Basinger
*Attorney, Agent, or Firm*—Michael A. Glenn; Donald M. Hendricks

[57] ABSTRACT

An expandable swim flipper includes a blade having at least an expandable portion thereof. The expandable portion radially expands in response to water resistance directed to a first surface of the blade. The surface area of the flipper is correspondingly increased to propel a swimmer at a faster rate through the water. The expandable portion radially contracts in response to water resistance directed to a second surface of the blade. The surface area of the flipper is correspondingly reduced, and is thereby subject to decreased water resistance. In a first preferred embodiment of the invention, the flipper blade is formed of expandable lateral members joined to a central member having a constant width. In a second, equally preferred embodiment, the flipper blade is formed of lateral members having a constant width and joined to an expandable central member. In a third, equally preferred embodiment of the invention, the flipper blade is expandable over its entire width. Rigid axial supports, or vertical flexors may be provided to supply additional structural support to the swim flipper.

21 Claims, 6 Drawing Sheets

EXPANDABLE SWIM FLIPPER

BACKGROUND OF THE INVENTION

1. Technical Field

The invention relates to athletic equipment. More particularly, the invention relates to a foot flipper device for aiding a swimmer.

2. Description of the Prior Art

Propulsion in swimming involves a combination of different forces. Swimmers are propelled primarily by drag forces and assisted by some lift. There is no fixed point in the water from which a swimmer may push. To move the body forward, a swimmer moves water backwards with hands and legs. Lift forces in swimming are primarily caused by the angle of attack of the hands, legs, and feet. The force thus contributed to propulsion is explained by Newton's third law of motion, to wit:

"To every action there is an equal and opposite reaction".

In accordance with the nature of the invention, further discussion will be limited to the contribution of the leg and foot to the propulsive forces. As the surface of the foot is angled and moved during a kick, the water it encounters is deflected and forced away. Friction causes the leg and foot movements to slow, as the force of the kick is imparted to the water. A force or pressure is thus created that acts upon the surfaces of the leg and foot in an equal and opposite direction. This pressure produces the main force in swimming that propels the body forward.

Certain aquatic mammals, such as the walrus, have finned members to assist in swimming. The hind limbs of the walrus have flexible fins that are radially expandable. The fins are enlarged to provide a greater surface area on the downstroke (or power stroke) kick. The amount of water forced away from the swimming walrus is thereby maximized. The fins are contracted to provide a lesser surface area on the upstroke, minimizing the water resistance encountered. The walrus thus uses the radially expandable fins to optimize its swimming efficiency.

Foot flipper or fin devices are used by swimmers to assist in their propulsion through water. FIG. 1 is a top view of a swim flipper 10, according to the prior art. The foot is inserted into the shoe 14 of the flipper. The blade 12 extends from the shoe and provides an enlarged surface area 16 that pushes the water on both the upstroke and the downstroke kick. Such enlarged surface area imparts the force of a kick to a larger area of water. The resulting increased equal and opposite pressure acting upon the foot surface propels the swimmer at a faster rate through the water.

It is known to provide rigid members 18 to provide axial support to the blade. Some prior art flipper blades also have channels 20 running along the edges of the blade to facilitate water flow. However, the flippers known in the prior art have a constant width 22 and are not radially expandable. Therefore, the prior art swim flippers maintain a constant surface area on both upstroke and downstroke kicks.

FIGS. 2 and 3 are sides view of a prior art swim flipper during an upstroke and a downstroke kick, respectively. An upstroke, as used herein, is a kick towards the surface of the water 24 by a swimmer performing a standard freestyle crawl stroke. As the flipper moves upward, water resistance 26 opposes the flipper's motion, causing the blade to bend downward 28. (see FIG. 2). A downstroke is a kick away from the water surface. The water resistance 26 is now directed up towards the flipper, causing the blade to bend upwards 30. (see FIG. 3).

The features that have the most influence on the performance of a foot flipper are surface area, flexibility, and weight. Enlarged surface area imparts the force to a larger area of water, but subjects the swimmer to increased water resistance. Flexibility provides increased lift forces through the optimization of the angle of attack of the feet. Additionally, less strength and effort is required to kick with a lighter weight foot flipper.

One prior art fin is described in Beauchat, Foot Flipper Device, U.S. Pat. No. 4,300,255(17 Nov. 1981). The Beauchat foot flipper comprises a shoe having a fin with a longitudinal cross-section of generally double curvature. The front portion of the shoe forms a separate assembly from the flipper. A rib that may traverse at least a portion of the concave curvature at the tip of the flipper provides axial rigidity.

The first curvature is arranged to make the fin adopt a position extending along the axis of the swimmer's leg. The second curve is adapted to make it possible, during the downstroke kick, for the tip of the flipper to conserve an angle of attack which is as close as possible to the axis of the leg, rather than the foot. (col. 2, lines 32–35). During the ascending movement of the leg, the flipper is flattened against the sole of the foot to provide a propulsive force.

The Beauchat foot flipper operates on the assumption that the maximum force of a kick is provided when the angle of attack corresponds to the axis of the swimmer's leg. However, force is required to bend the flipper to orient it to the axis of the leg. This force is not available to provide propulsive power to the swimmer.

Beauchat recognizes that the downstroke kick provides a greater propulsive force than the upstroke. However, the Beauchat flipper does not take advantage of this situation by increasing the available surface area during the downstroke kick. Furthermore, the Beauchat design does not reduce the surface area during the upstroke to minimize the increased water resistance of the upstroke. Rather, the surface area of the flipper remains constant throughout.

Another foot flipper design is described in Cressi, Swimming Flipper Made of Two Different Materials, U.S. Pat. No. 4,954,111(4 Sep. 1990). The Cressi flipper has a blade whose outer sole extends under the heel of the shoe. The blade is equipped with an arched strap which surrounds the shoe transversely.

Cressi is directed to solving the problem of providing a comfortable soft shoe material without compromising the effectiveness of the flipper. The flipper blade is formed of a harder material than the shoe. However, by extending the blade under the heel of the shoe, the deformation caused by the bending of the softer shoe material is minimized. Additionally, the outer portion of the sole is fitted with a transverse strap. The strap holds the foot against the outer sole and blade when the foot is moved upwards.

However, Cressi does not address improving the effectiveness of the propulsion generated by the flipper design. Rather, Cressi is directed to improving the comfort of the design. Thus, there is no disclosure of increasing the available surface area during the downstroke kick to maximize the propulsive force. Furthermore, there is no discussion of reducing the frictional resistance during the upstroke to minimize the strength exerted by the swimmer.

In Tomlinson , Water Surface Running Fins for the Feet, U.S. Pat. No. 4,787,871(29 Nov. 1988), a flipper device is modified to enable a user to run on the surface of a body of water. The flipper blade is formed of a plurality of pivotally connected fingers. As the user runs, these fingers pivot to reduce water drag in preparation for the next forward motion stroke.

There is no discussion in Tomlinson as to the applicability of this design to swimming flippers. Furthermore, the Tomlinson device maintains a constant surface area during use.

It would therefore be an advantage to provide a swim flipper that mimics the hind fins of a walrus to optimize the propulsion of a swimmer through the water. It would be a further advantage if such swim flipper were radially expanded to a greater surface area on a downstroke kick to maximize the amount of water forced away from the swimmer. It would be yet a another advantage if such swim flipper were radially contracted to a lesser surface area on an upstroke to minimize the water resistance encountered.

SUMMARY OF THE INVENTION

The invention provides an expandable swim flipper for efficiently propelling a swimmer. The swim flipper mimics the fin structure of an aquatic mammal. The swim flipper expands radially to provide a greater surface area during a downstroke kick. The enlarged surface area maximizes the amount of water forced away from the swimmer to propel the swimmer at a faster rate through the water. On an upstroke kick, the swim flipper contracts radially to provide a lesser surface area, thereby minimizing water resistance encountered.

In a first preferred embodiment of the invention, the flipper blade is formed of expandable lateral members joined to a central member having a constant width. In a second, equally preferred embodiment, the flipper blade is formed of lateral members having a constant width and joined to an expandable central member. In a third, equally preferred embodiment of the invention, the flipper blade is expandable over its entire width. Rigid axial supports, or vertical flexors may be provided to supply additional structural support to the swim flipper.

DETAILED DESCRIPTION OF THE INVENTION

The invention provides an expandable swim flipper for efficiently propelling a swimmer. The flipper includes a flexible blade for propelling water behind the swimmer. During a kick, the force generated by the swimmer's leg (one of the largest muscle groups) is transferred to the water through the foot and toe muscles (a small muscle group). A flipper is designed to catch water and push it behind to propel the swimmer.

As the swimmer kicks downward for example, during a crawl stroke, the water resistance is directed upward towards the surface of the flipper blade. Upon contacting the blade surface, the water urges an expandable portion of the blade to radially expand. The surface area of the swim flipper is thereby increased.

The enlarged surface area imparts the force of the kick to force away a greater quantity of water. The resulting increased equal and opposite pressure acting upon the foot surface propels the swimmer at a faster rate through the water.

As the swimmer kicks upward, the water resistance is directed downward towards the surface of the blade. Upon contacting the blade surface, the water urges the expandable portion of the blade to radially contract and fold. The surface area of the swim flipper is thereby decreased.

As a result of the diminished surface area, the blade is subject to decreased water resistance. An upstroke kick is generally weaker than a downstroke kick, for various reasons relating to physiology and the mechanics of the particular crawl stroke. However, with a diminished surface area, the force of the water resistance against the flipper is correspondingly reduced. Thus, the flipper is more easily advanced through the water.

Figure 1:
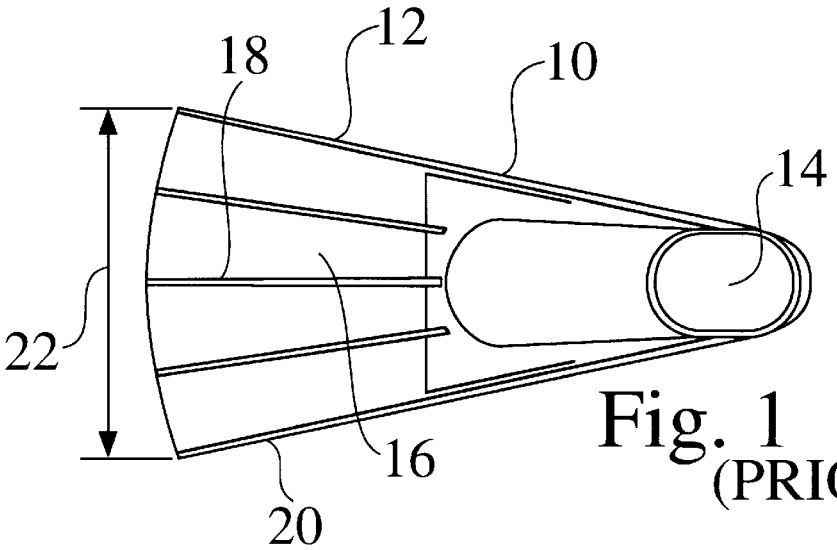
Fig. 1 (PRIOR ART)
FIG. 1 is a top view of a swim flipper, according to the prior art.
Figure 2:
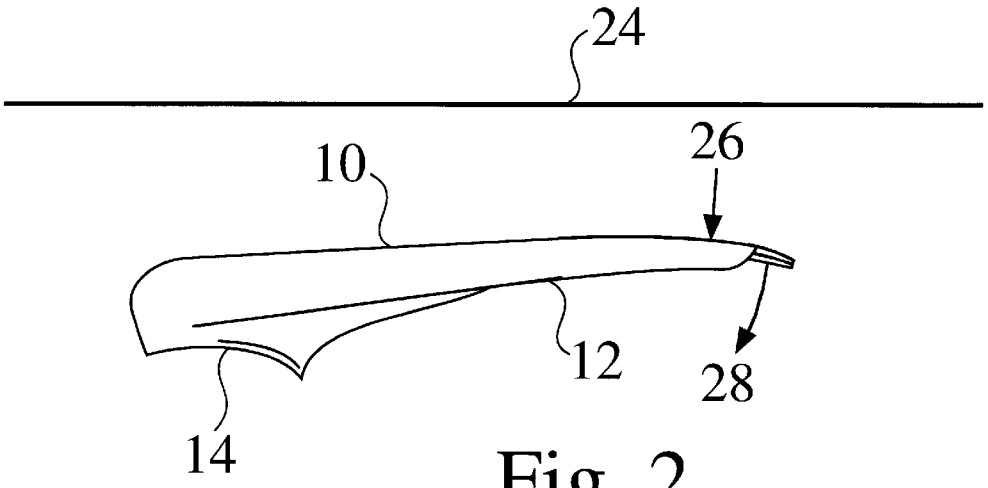
Fig. 2 (PRIOR ART)
FIG. 2 is a side view of a swim flipper during an upstroke, according to the prior art.
Figure 3:
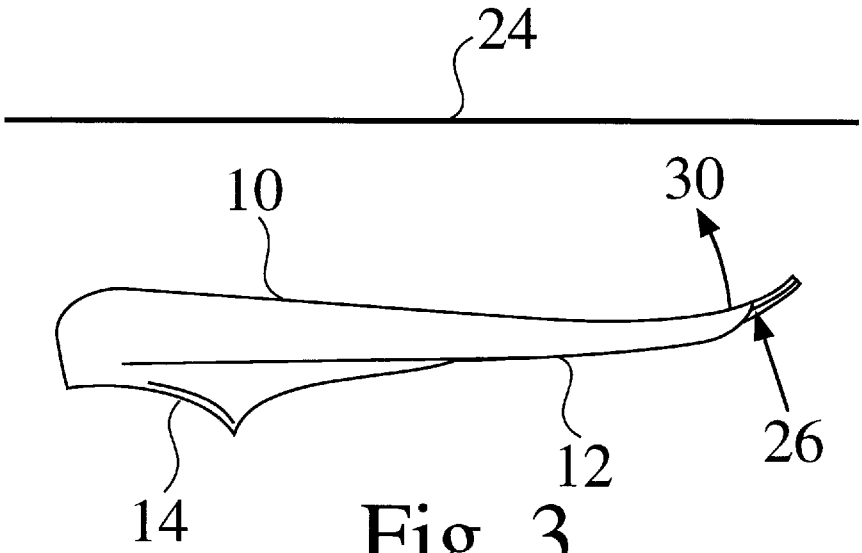
Fig. 3 (PRIOR ART)
FIG. 3 is a side view of a swim flipper during a down stroke, according to the prior art.
Figure 4:
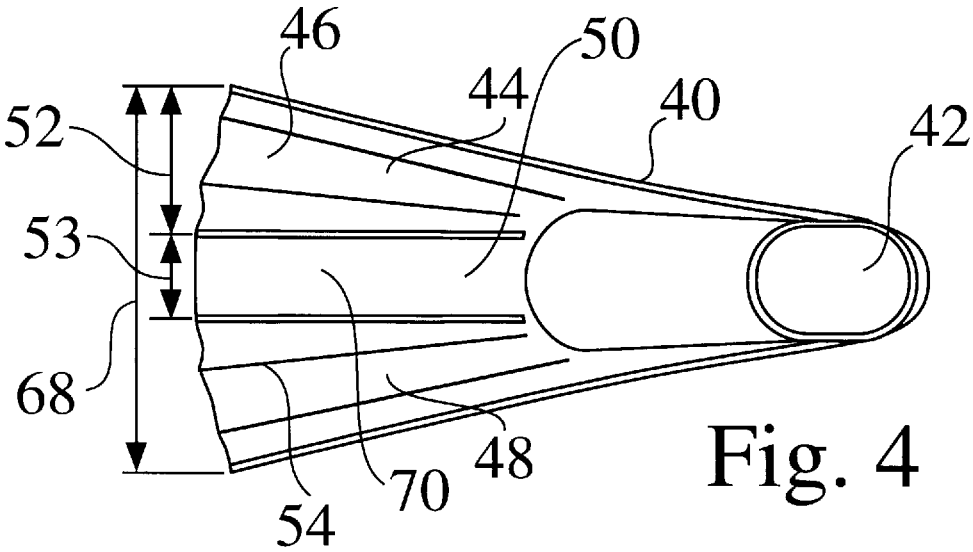
FIG. 4 is a top view of an expanded swim flipper, according to a first preferred embodiment of the invention.

FIG. 4 is a top view of an expanded swim flipper 40, according to a first preferred embodiment of the invention. The flipper includes a blade 46 joined to a shoe 42, into which the user inserts a foot. The shoe may comprise any known arrangement for securing the fin to the swimmer's foot, such as a strap or other such means. In the first embodiment of the invention, the blade is formed of a central member 50 joined between two lateral members 44, 48. The central member maintains a constant width 53 throughout both the upstroke and downstroke of a kick. Alternatively, the central member may fold in half and envelope the two lateral members during the upstroke.

Figure 5:
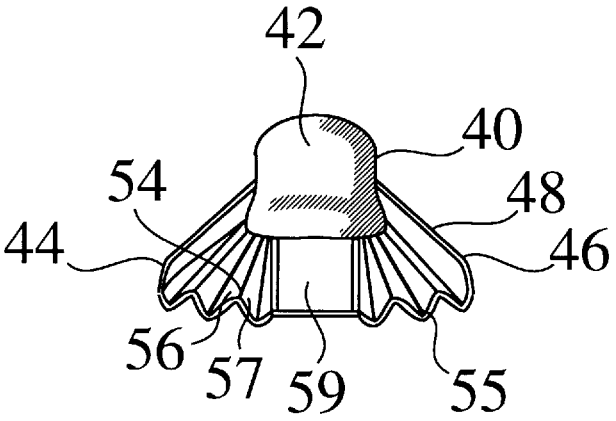
FIG. 5 is a front view of a pleated swim flipper, according to the invention.

One or more of the lateral members, however, are radially expandable. In one embodiment of the invention, shown in FIG. 5, a lateral member comprises at least one axial pleat 54 separating fixed panels 56, 57. The lateral member can thus be folded inward or expanded outward like a fan.

Each pleat is arranged to form a pocket 55 in the front surface 59 of the blade. The pocket catches the water on the downstroke kick, and is filled thereby to expand the lateral member. On the upstroke kick, the lateral members converge at a central portion of the fin and provide a rigid control structure about which the pleats are folded by action of the water pressing against them. In this way, the fin is forced to assume a minimal profile, thereby reducing drag of the fin and accordingly increasing the fin's efficiency. Further, this embodiment of the invention provides an easily transported folding flipper. That is, the flipper may be stored in its folded (i.e. minimal profile) configuration, e.g., for storage in a suitcase during travel. In this way, the herein-disclosed flipper provides an additional advantage of being compact and well suited for use when traveling, e.g., when on vacation.

Figure 6:
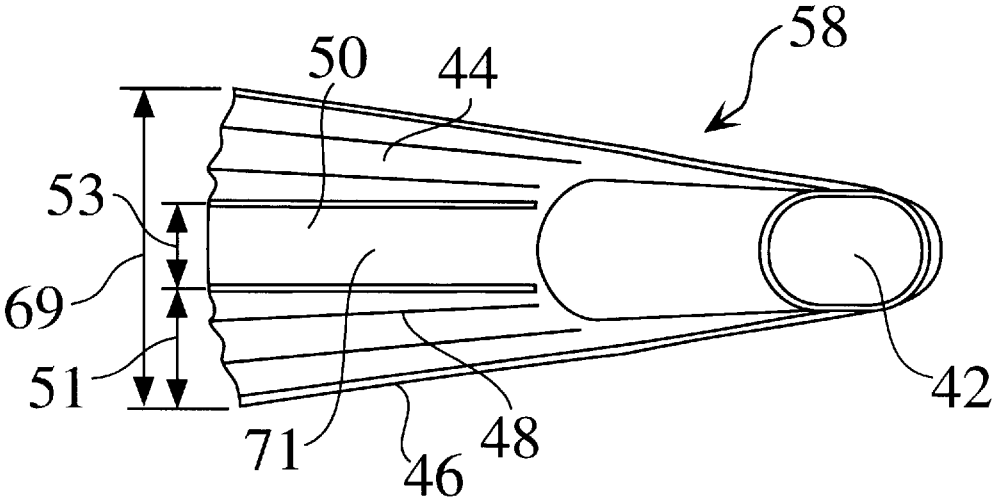
FIG. 6 is a top view of a contracted swim flipper, according to a first preferred embodiment of the invention.

As shown in FIG. 4, when expanded outward, the width 52 of the lateral members is increased, thereby increasing the width 68 and surface area 70 of the flipper. FIG. 6 is a top view of the contracted swim flipper 58, according to the first preferred embodiment of the invention. When folded inward, the width 51 of the lateral members is decreased, and the width 69 and surface area 71 of the blade are correspondingly diminished.

Figure 7:
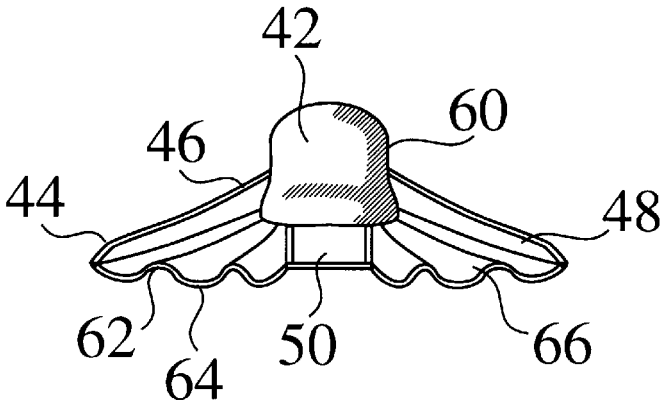
FIG. 7 is a front view of a ridged swim flipper, according to the invention.

In another embodiment of the invention, a lateral member includes at least one ridge. FIG. 7 is a front view of a ridged swim flipper 60. Convex 62 and concave 64 curved ridges alternate across the surface 66 of the lateral member. The lateral member can thus be contracted inward or expanded outward like an accordion.

The ridges may be arranged to provide a pocket (not shown) that fills with water and expands on the downstroke. Alternately, the ridges may be formed of an expandable material that is configured to expand when pressure is applied in only one direction, and contract when pressure is applied in an opposing direction. Thus, the blade expands radially during a downstroke kick, and contracts during an upstroke.

At least some of the curved ridges must be formed of an expandable material, such as rubber. In one embodiment of the invention, expandable ridges alternate with inflexible ridges. In an alternate embodiment of the invention, all of the ridges are expandable.

The flipper blade requires sufficient axial support to maintain the blade's rigidity against the water resistance. Such support may be provided through use of a resilient material having sufficient structural rigidity. Alternately, the structural support may be provided by use of rigid support members (see FIG. 12, described below). Non-expandable ridges may provide axial rigidity in the ridged swim flipper. The fixed panels or pleats may provide such support in the pleated swim flipper.

Figure 8:
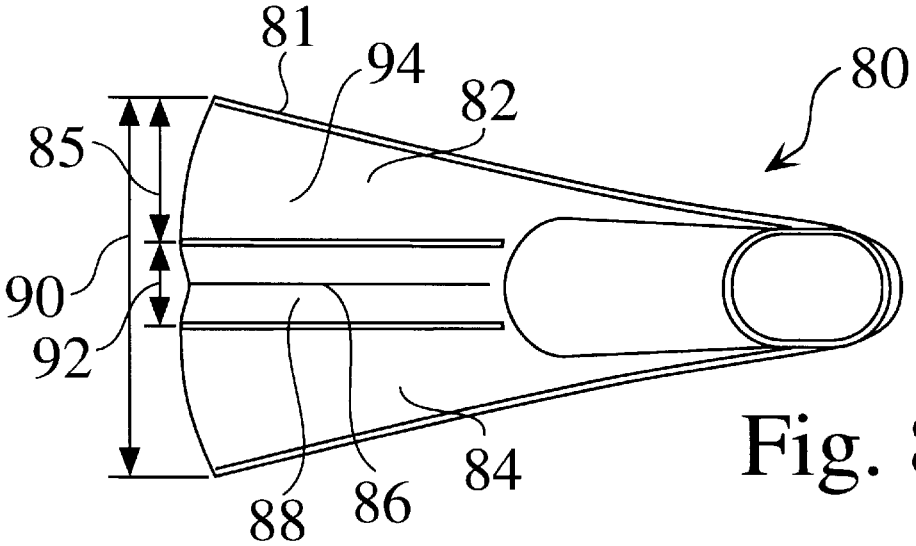
FIG. 8 is a top view of an expanded swim flipper, according to a second equally preferred embodiment of the invention.

FIG. 8 is a top view of an expanded swim flipper 80, according to a second equally preferred embodiment of the invention. In this embodiment, the flipper blade 81 is formed of two lateral members 82, 84 having a constant width 85. An expandable central member 88 is joined therebetween. While FIG. 8 shows a central member having a single pleat 86, it is readily apparent that the central member may have a plurality of pleats, in any appropriate spaced configuration. The central member may also be ridged, as discussed above, or formed of a flexible, resilient material.

Figure 9:
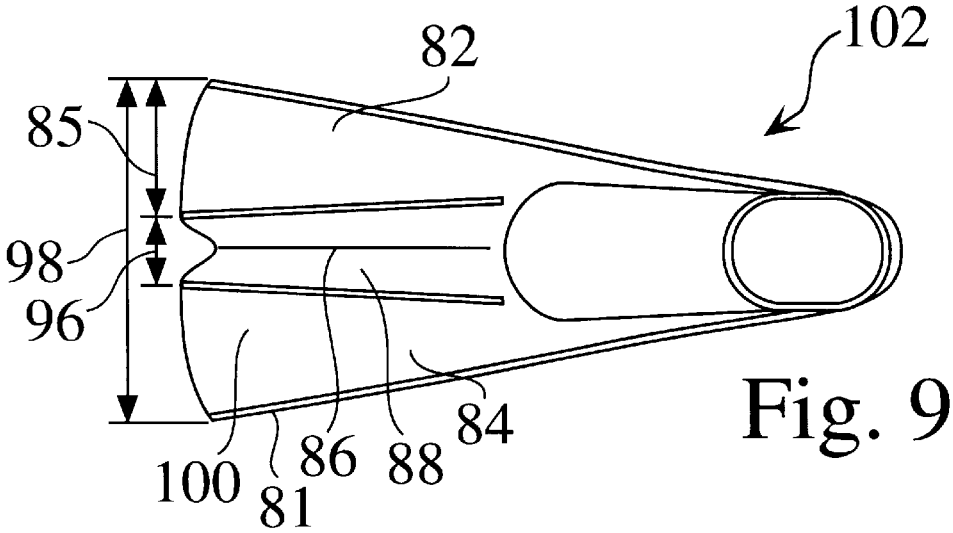
FIG. 9 is a top view of a contracted swim flipper, according to a second equally preferred embodiment of the invention.

The upward force of the water on the surface of the blade during a downstroke kick expands the central member to a greater width 92. The width 90 and surface area 94 of the blade are correspondingly increased. Similarly, the downward force of the water on the surface of the blade during an upstroke kick contracts the central member to a smaller width 96, as shown in FIG. 9. The width 98 and surface area 100 of the blade 81 of the contracted flipper 102 are correspondingly decreased.

Figure 10:
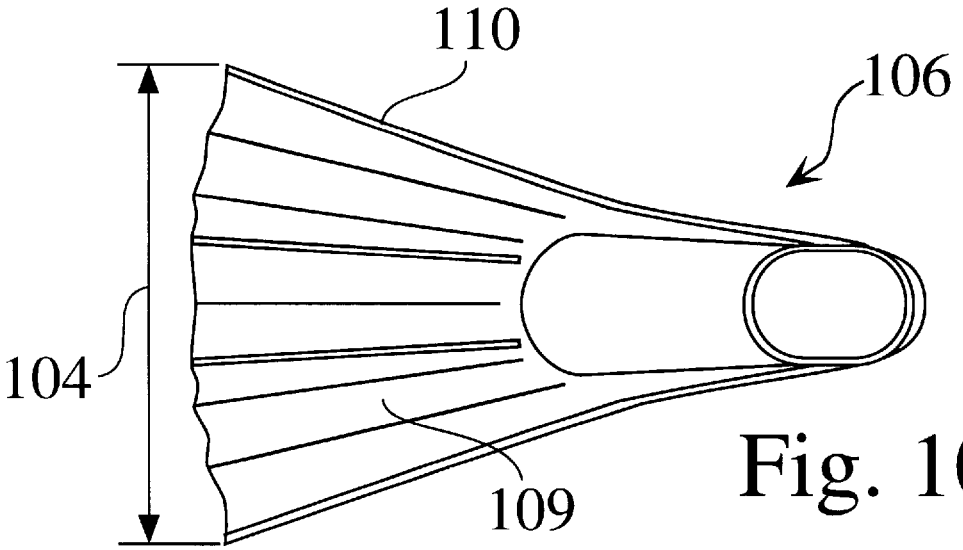
FIG. 10 is a top view of an expanded swim flipper, according to a third equally preferred embodiment of the invention.
Figure 11:
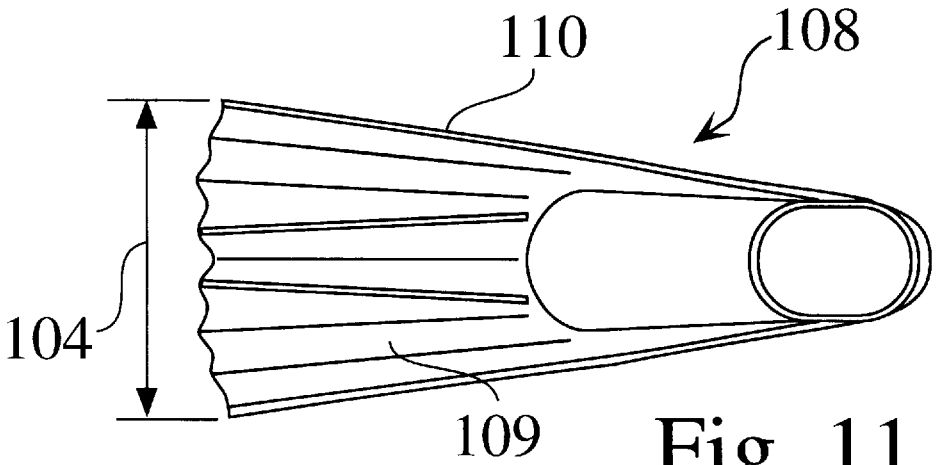
FIG. 11 is a top view of a contracted swim flipper, according to a third equally preferred embodiment of the invention.

In a third, equally preferred embodiment of the invention, the flipper blade 110 is expandable over its entire width 104. FIGS. 10 and 11 are top views, respectively, of an expanded 106 and contracted swim flipper 108 according to this third embodiment of the invention. While the Figures show a pleated blade 109, it is readily apparent that the blade may alternately be ridged.

Although the invention is described herein with reference to the preferred embodiment, one skilled in the art will readily appreciate that other applications may be substituted for those set forth herein without departing from the spirit and scope of the present invention.

Figure 12:
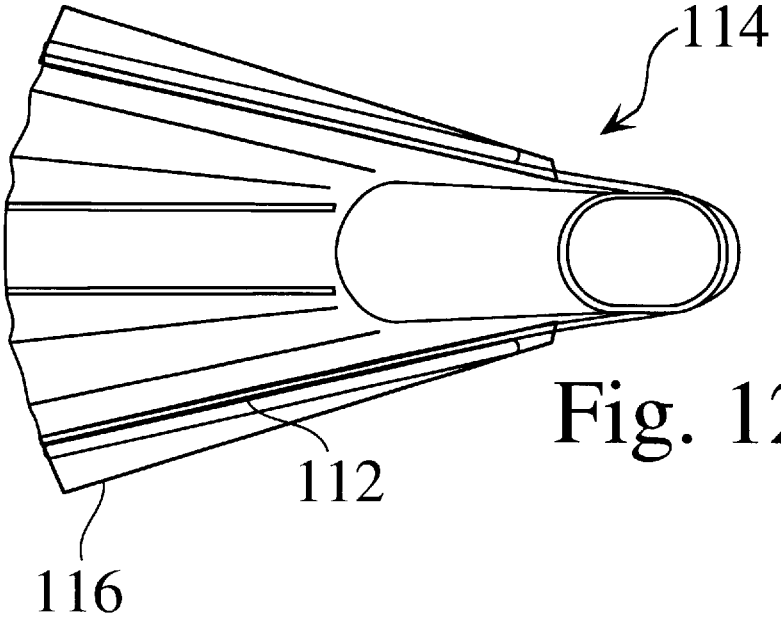
FIG. 12 is a top view of a swim flipper, according to the invention.
Figure 13:
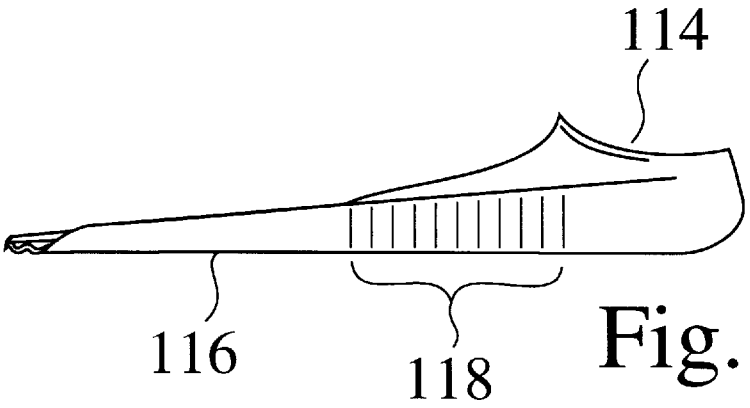
FIG. 13 is a side view of a swim flipper, according to the invention.

For example, shown in FIG. 12, one or more rigid support members 112 is used to provide axial support to the blade 116 of the flipper 114. The rigid supports may be formed within the flipper blade, or may be joined to the top or bottom surfaces thereof. Vertical flexors 118 may also be included within the flipper to provide additional support for the sole of the foot, as shown in FIG. 13.

While the Figures show pleated and ridged blades, the expandable portions of the blades may be formed by any other suitable material or means, such as hinges or elastics. The flippers may be formed of any appropriate materials or combinations of materials that provide flexibility and expandability, while retaining the requisite level of axial support.

While the invention is described herein with respect to the freestyle crawl stroke, one skilled in the art will readily appreciate that invention may be applied to other swim strokes, with the appropriate adjustment made for the direction of the kick during the particular stroke. For example, the invention may be used to aid a swimmer performing the backstroke. However, since the directions of the kicks are reversed with respect to the freestyle crawl, the expansion and contraction of the flipper is correspondingly reversed.

The flipper blades may have any number of members, or types of members. For example, both pleated and ridged members may alternate with members having a constant width. A plurality of central members may be provided. One or more of these central members may be radially expandable. Similarly, two or more lateral members may be provided, and one or more of these lateral members may be radially expandable. Alternately, the blade may be formed of two members, with a central pleat or ridge therebetween to permit the blade to expand and contract. The invention may include channels running along the edges of the blade to facilitate water flow. Accordingly, the invention should only be limited by the claims included below.

We claim:

1. A swim flipper, comprising:

a shoe; and a blade having an upper surface, a lower surface, a width and a surface area and including at least an expandable portion thereof and joined to said shoe;

wherein in a first position, said expandable portion of said blade is radially expanded to increase said width and said surface area in response to water resistance directed to said upper surface of said blade;

wherein in a second position, said expandable portion of said blade is radially contracted to decrease said width and said surface area in response to water resistance directed to said lower surface of said blade.

2. The apparatus of claim 1, wherein said expandable portion of said blade comprises at least one axial pleat separating a plurality of fixed panels.

3. The apparatus of claim 1, wherein said expandable portion of said blade comprises at least one ridge.

4. The apparatus of claim 3, further comprising a plurality of alternating convex and concave curved ridges across a surface of said expandable portion.

5. The apparatus of claim 1, further comprising at least one rigid support member joined to said blade for providing axial support thereto.

6. The apparatus of claim 1, further comprising at least one vertical flexor within said flipper to provide support thereto.

7. The apparatus of claim 1, wherein said blade further comprises:

at least two lateral members; and at least one central member joined therebetween.

8. The apparatus of claim 7, wherein at least one of said at least one central member is radially expandable.

9. The apparatus of claim 7, wherein at least one of said lateral members is radially expandable.

10. The apparatus of claim 1, wherein said blade is radially expandable over the entirety of said width.

11. A swim flipper, comprising:

at least two lateral members and at least one central member joined therebetween to form a blade having an upper surface, a lower surface, a width and a surface area and including at least an expandable portion thereof; and a shoe joined to said blade and adapted to receive a foot;

wherein in a first position, said expandable portion of said blade is radially expanded to increase said width and said surface area in response to water resistance directed to said upper surface of said blade;

wherein in a second position, said expandable portion of said blade is radially contracted to decrease said width and said surface area in response to water resistance directed to said lower surface of said blade.

12. The apparatus of claim 11, wherein said expandable portion of said blade is at least one of said at least one central member.

13. The apparatus of claim 11, wherein said expandable portion of said blade is at least one of said lateral members.

14. The apparatus of claim 11, wherein said blade is radially expandable over the entirety of said width.

15. The apparatus of claim 11, wherein said expandable portion of said blade comprises at least one axial pleat separating a plurality of fixed panels.

16. The apparatus of claim 15, wherein said two lateral members converge at a central portion of said blades in said second position to provide a rigid central structure about which said at least one pleat is folded by action of water pressing thereagainst.

17. The apparatus of claim 11, wherein said expandable portion of said blade comprises at least one ridge.

18. The apparatus of claim 17, further comprising a plurality of alternating convex and concave curved ridges across a surface of said expandable portion.

19. The apparatus of claim 11, further comprising at least one rigid axial support member joined to said blade for providing axial support thereto.

20. The apparatus of claim 11, further comprising at least one vertical flexor within said flipper to provide support thereto.

21. The apparatus of claim 11, wherein said second position further comprises a folded, storage configuration for said swim flipper.

* * * * *